US008206555B2

(12) United States Patent
Klerelid et al.

(10) Patent No.: US 8,206,555 B2
(45) Date of Patent: Jun. 26, 2012

(54) METHODS EMPLOYING AN IMPERMEABLE TRANSFER BELT IN A PAPERMAKING MACHINE

(75) Inventors: Ingvar Berndt Erik Klerelid, Karlstad (SE); Hans Ivarsson, Karlstad (SE); Johan Ulf Ragard, Karlstad (SE); Frank Stephen Hada, Appleton, WI (US); Paul Douglas Beuther, Neenah, WI (US); Jeffrey Dean Holz, Sherwood, WI (US)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 13/309,192

(22) Filed: Dec. 1, 2011

(65) Prior Publication Data

US 2012/0073777 A1 Mar. 29, 2012

Related U.S. Application Data

(62) Division of application No. 13/023,119, filed on Feb. 8, 2011, now Pat. No. 8,092,651, which is a division of application No. 12/875,655, filed on Sep. 3, 2010, now Pat. No. 7,988,829, which is a division of application No. 11/924,835, filed on Oct. 26, 2007, now Pat. No. 7,811,418.

(51) Int. Cl.
*D21F 11/04* (2006.01)

(52) U.S. Cl. ..... 162/203; 162/358.2

(58) Field of Classification Search ..... 162/203, 162/358.2, 206, 361, 358.4
See application file for complete search history.

(56) References Cited

U.S. PATENT DOCUMENTS

| | | | |
|---|---|---|---|
| 4,483,745 | A | 11/1984 | Wicks et al. |
| 4,500,588 | A | 2/1985 | Lundstrom |
| 4,529,643 | A | 7/1985 | Lundstrom |
| 4,976,821 | A | 12/1990 | Laapotti |
| 5,002,638 | A | 3/1991 | Gulya et al. |
| 5,298,124 | A | 3/1994 | Eklund et al. |
| 6,287,426 | B1 | 9/2001 | Edwards et al. |
| 6,319,365 | B1 | 11/2001 | Inoue |
| 6,531,033 | B1 | 3/2003 | Kawashima |
| 6,547,924 | B2 | 4/2003 | Klerelid et al. |
| 6,743,339 | B1 | 6/2004 | Nilsson et al. |

*Primary Examiner* — Mark Halpern
(74) *Attorney, Agent, or Firm* — Alston & Bird LLP

(57) ABSTRACT

A papermaking machine for making paper includes a forming section, a press section, and a drying section. The paper web is pressed between two press members while enclosed between a press felt and a transfer belt having non-uniformly distributed microscopic depressions in its surface, the web following the transfer belt from the press to a transfer point at which the web is transferred via a suction transfer device onto a structuring fabric, the web then being dried on a drying cylinder. The transfer point is spaced a distance D from the press nip selected based on machine speed, a basis weight of the web, and the surface characteristics of the transfer belt, such that within the distance D a thin water film between the web and the transfer belt at least partially dissipates to allow the web to be separated from the transfer belt.

3 Claims, 7 Drawing Sheets

METHODS EMPLOYING AN IMPERMEABLE TRANSFER BELT IN A PAPERMAKING MACHINE

CROSS-REFERENCE TO RELATED APPLICATIONS

This application is a divisional of currently pending application Ser. No. 13/023,119 filed Feb. 8, 2011, which is a divisional of application Ser. No. 12/875,655 filed Sep. 3, 2010, now issued as U.S. Pat. No. 7,988,829, which is a divisional of application Ser. No. 11/924,835 filed Oct. 26, 2007, now issued as U.S. Pat. No. 7,811,418, the entire disclosures of said applications being hereby incorporated herein by reference.

BACKGROUND OF THE INVENTION

The present disclosure relates to papermaking. More particularly, the present disclosure relates to a papermaking machine for making a paper web, and associated methods.

Many attempts to combine the bulk-generating benefit of throughdrying with the dewatering efficiency of wet-pressing have been disclosed over the past 20 years. An example of such a process is disclosed in U.S. Pat. No. 6,287,426 issued Sep. 11, 2001 to Edwards et al., which is herein incorporated by reference. This process utilizes a high pressure dewatering nip formed between a felt and an impermeable belt to increase the wet web consistency to about 35 to 50 percent. The web adheres to and follows the impermeable belt as it exits the press nip. The dewatered web is then transferred to a structuring fabric with the aid of a vacuum roll to impart texture to the web prior to drying.

Transfer belts having a regular or uniform grooved microstructure on their surface running in the machine direction have been used for transferring a web from a press felt to a further downstream process. The grooved belt is compressed flat in the dewatering press nip, allowing the dewatered web to transfer to the belt, but then rebounds to its natural grooved state soon after leaving the press. While effective for relatively heavy basis weight webs, the use of such modified belts still is not effective for processing light-weight tissue webs at high speeds necessary for commercial applications because of the difficulty associated with transferring low basis weight wet webs, which have virtually no strength. A wet tissue web will not naturally make such a transfer because there is a thin water film between the tissue web and the belt surface that generates a high adhesion force between the two materials. Attempts to remove the fragile tissue web from the belt surface often result in torn webs.

Therefore, there is a need for an efficient method of making wet-pressed paper webs at high speeds.

BRIEF SUMMARY OF THE DISCLOSURE

The present disclosure is directed to a papermaking machine and associated methods for forming a fibrous paper web from papermaking fibers, and in some embodiments for structuring the tissue web for increasing its effective bulk. In accordance with a first aspect of the disclosure, a papermaking machine for making a paper web comprises a forming section for forming a wet paper web, a press section arranged to receive the wet paper web from the forming section and operable to press the wet paper web to partially dewater the web, and a drying section for drying the paper web. The press section comprises at least one press having two cooperating press members forming a press nip therebetween, and a press felt arranged in a loop such that the press felt passes through the press nip. The papermaking machine further comprises an impermeable transfer belt arranged in a loop such that the transfer belt passes through the press nip and the wet paper web passes through the press nip enclosed between the press felt and the transfer belt. The papermaking machine further includes a final fabric arranged in a loop within which a suction transfer device is disposed.

The suction transfer device has a suction zone in which suction is exerted through the final fabric, the suction zone including a transfer point spaced a distance D from the press nip in a machine direction along which the transfer belt runs, the transfer belt being arranged to bring the paper web into contact with the final fabric in the suction zone for a length L in the machine direction, such that suction is exerted on the paper web to transfer the paper web from the transfer belt onto the paper fabric at the transfer point.

The transfer belt has a surface in contact with the wet paper web characterized by a non-uniform distribution of microscopic-scale pits or depressions. By "microscopic-scale" is meant that the average diameter of the depressions is less than about 200 μm. For example, the depressions can range from 10 μm to about 200 μm, and more particularly from about 50 μm to about 200 μm in size. By "non-uniform" is meant that the depressions do not form a regular pattern but instead have an essentially random spatial distribution over the surface of the belt.

In one embodiment, the surface of the transfer belt (also referred to as a "particle belt") that contacts the wet paper web is formed by a coating of a polymeric resin having inorganic particles dispersed therein. The particles give the web-contacting surface a microscopically rough topography characterized by a non-uniform or random distribution of depressions. However, the desired belt surface can be provided in other ways. For example, a foamed polymeric surface can be formed and then sanded to expose the gas-filled pores of the foam, thus forming microscopic-scale depressions in the surface.

In one embodiment, the transfer belt runs at a speed of at least 1000 m/min, the distance D is at least about 2 m, and the length L is at least about 10 mm during machine operation.

In particular embodiments, the suction transfer device has a curved outer surface about which the final fabric is partially wrapped, and the transfer belt partially wraps the outer surface of the suction transfer device with the final fabric disposed between the suction transfer device and the transfer belt having the paper web thereon. For example, the transfer belt can wrap the suction transfer device for the length L, measured as an arc length while vacuum is applied, of about 10 mm to about 200 mm, such as about 10 mm to about 50 mm, the transfer belt diverging from the final fabric at a point P located at an outgoing end of the arc length L.

In one embodiment, the suction zone Z is longer than the arc length L and extends downstream of the point P. The point P can be located intermediate between upstream and downstream ends of the suction zone Z in the machine direction.

In some embodiments, the papermaking machine is configured for making a tissue web having a basis weight less than about 20 grams/$m^2$ ("gsm"). Further, some embodiments are configured for making a structured tissue web, wherein the final fabric is a structuring fabric (also referred to as a "texturizing fabric") for imparting a structure to the tissue web for enhancing its effective bulk. The suction transfer device suctions the damp tissue web onto the structuring fabric to cause the tissue web to conform to its structured surface.

In accordance with another aspect of the disclosure, a method of configuring and operating a papermaking machine for making a paper web is provided. The method comprises steps of using a forming section to form a wet paper web, using a press section as previously described to press and dewater the wet paper web, and using a drying section to dry the paper web. The method further comprises the step of selecting the distance D between the press nip and the transfer point taking into account at least a linear speed of the transfer belt, a basis weight of the paper web, and a roughness characteristic of the surface of the transfer belt in contact with the wet paper web, such that within the distance D a thin water film between the paper web and the surface of the transfer belt at least partially dissipates to allow the paper web to be separated from the transfer belt without breaking.

In another aspect, the present disclosure describes a method for making a wet-pressed tissue comprising: (a) forming a wet tissue web having a basis weight of about 20 grams or less per square meter by depositing an aqueous suspension of papermaking fibers onto a forming fabric; (b) carrying the wet tissue web to a dewatering pressure nip while supported on a papermaking felt; (c) compressing the wet tissue web between the papermaking felt and a particle belt, whereby the wet tissue web is dewatered to a consistency of about 30 percent or greater and transferred to the surface of the particle belt; (d) transferring the dewatered web from the particle belt to a texturizing fabric, with the aid of vacuum, to mold the dewatered web to the surface contour of the fabric; (e) pressing the web against the surface of a Yankee dryer while supported by a texturizing fabric and transferring the web to the surface of the Yankee dryer; and (f) drying and creping the web to produce a creped tissue sheet.

The wet tissue web can be dewatered to a consistency of about 30 percent or greater, more specifically about 40 percent or greater, more specifically from about 40 to about 50 percent, and still more specifically from about 45 to about 50 percent. As used herein and well understood in the art, "consistency" refers to the bone dry weight percent of the web based on fiber.

The level of compression applied to the wet web to accomplish dewatering can advantageously be higher when producing light-weight tissue webs. Suitable press loads have a peak pressure of about 4 MPa or greater, more specifically from about 4 to about 8 MPa, and still more specifically from about 4 to about 6 MPa.

The machine speed for the method described above can be about 1000 meters per minute or greater, more specifically from about 1000 to about 2000 meters per minute, more specifically from about 1200 to about 2000 meters per minute, and still more specifically from about 1200 to about 1700 meters per minute. As used herein, the machine speed is measured as the linear speed of the particle belt.

The dwell time, which is the time the dewatered tissue sheet remains supported by the particle belt, is a function of the machine speed and the length of the particle belt run between the point at which the web transfers from the felt to the particle belt and the point at which the web transfers from the particle belt to the texturizing fabric. Because a light-weight wet tissue web is very weak, the water film between the web and the transfer belt needs to be well disrupted, more than for heavier paper grades, before subsequent transfer to the texturizing fabric is attempted. The water film break-up is a time-dependent process and, although various things (e.g., heat energy, electrostatic energy, surface energy, vibration) can accelerate it, the time available for the film to break up is reduced as the machine speed increases. Thus, all things being equal, the distance between the nip press and the point of transfer to the texturizing fabric (at the vacuum roll) needs to be increased beyond conventional distances in order to run faster. Similarly, the distance also needs to be increased in order to run lower basis-weight webs in order to achieve a more complete film break-up. It is estimated that the distance scales linearly with machine speed. Suitable distances between the nip press and the point of transfer to the texturizing fabric can be about 2.0 meters/1000 meters/minute of machine speed or greater, more specifically from about 2.5 to about 10 meters/1000 meters/minute of machine speed.

As used herein, a "texturizing fabric" (also referred to as a "structuring fabric") is a papermaking fabric, particularly a woven papermaking fabric, having a topographical or three-dimensional surface that can impart bulk to the final tissue sheet. Examples of such fabrics suitable for purposes of this invention include, without limitation, those disclosed in U.S. Pat. No. 5,672,248 to Wendt et al., U.S. Pat. No. 5,429,686 to Chiu et al., U.S. Pat. No. 5,832,962 to Kaufman et al., U.S. Pat. No. 6,998,024 B2 to Burazin et al., and U.S. Patent Application Publication 2005/0236122 A1 by Mullally et al., all of which are incorporated herein by reference.

The level of vacuum used to effect the transfer of the tissue web from the particle belt to the texturizing fabric will depend upon the nature of the texturizing fabric. In general, the vacuum can be about 5 kPa or greater, more specifically from about 20 to about 60 kPa, still more specifically from about 30 to about 50 kPa. The vacuum at the pick-up (vacuum transfer roll) plays a much more important role for transferring light-weight tissue webs from the transfer belt to the texturizing fabric than it does for heavier paper grades. Because the wet web tensile strength is so low, the transfer must be 100 percent complete before the belt and fabric separate, or else the web will be damaged. On the other hand, for heavier-weight paper webs there is sufficient wet strength to accomplish the transfer, even over a short micro-draw, with modest vacuum (20 kPa). For light-weight tissue webs, the applied vacuum needs to be much stronger in order to cause the vapor beneath the tissue to expand rapidly and push the web away from the belt and transfer the web to the fabric prior to fabric separation. On the other hand, the vacuum cannot be so strong as to cause pinholes in the sheet after transfer.

To further effect transfer and molding of the web into the texturizing fabric, the vacuum transfer roll may contain a second vacuum holding zone.

The transfer of the web to the texturizing fabric can include a "rush" transfer or a "draw" transfer. Rush transfers are transfers where the receiving fabric (downstream fabric) is traveling at a machine speed that is lower than the machine speed of the upstream fabric. Draw transfers are the opposite, i.e., the receiving fabric is traveling at a machine speed that is higher than the upstream fabric. Depending upon the nature of the texturizing fabric, rush transfer can aid in creating higher sheet caliper. When used, the level of rush transfer can be about 5 percent or less.

Fabric cleaning can be particularly advantageous, particularly using a method that leaves a minimal amount of water on the fabric (about 3 gsm or less). Suitable fabric cleaning methods include air jets, thermal cleaning, and high pressure water jets. Coated fabrics, which clean more-easily than non-coated fabrics, can be employed.

The bulk of the tissue sheets produced by the method of this invention can be about 10 cubic centimeters or greater per gram of fiber, more specifically from about 10 to about 20 cubic centimeters per gram of fiber (cc/g).

In the interest of brevity and conciseness, any ranges of values set forth in this specification are to be construed as written description support for claims reciting any sub-ranges having endpoints which are whole number values within the specified range in question. By way of a hypothetical illustrative example, a disclosure in this specification of a range of from 1 to 5 shall be considered to support claims to any of the following sub-ranges: 1-4; 1-3; 1-2; 2-5; 2-4; 2-3; 3-5; 3-4; and 4-5.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE DRAWINGS

The present inventions now will be described more fully hereinafter with reference to the accompanying drawings, in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
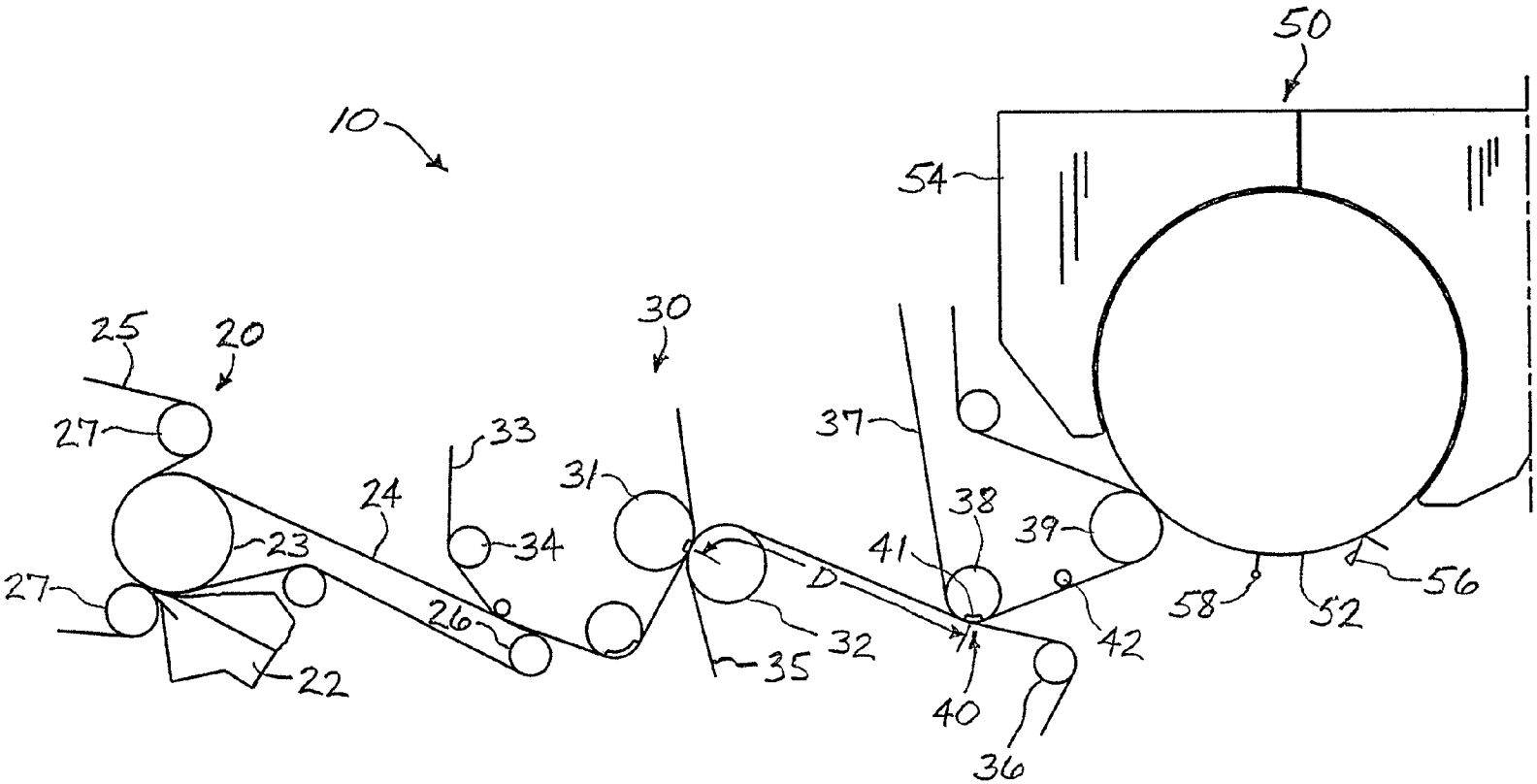
FIG. 1 is a schematic depiction of a papermaking machine in accordance with a first embodiment of the invention.

A papermaking machine 10 is illustrated in FIG. 1. The papermaking machine comprises a wet section or forming section 20, a press section 30 and a drying section 50. The wet section 20 comprises a headbox 22, a forming roll 23, an endless inner clothing 24, and an endless outer clothing 25 consisting of a forming wire. The inner and outer clothings 24 and 25 run in separate loops around several guide rolls 26 and 27 respectively.

The drying section 50 comprises a heated drying cylinder 52, which is covered by a hood 54. The drying cylinder and hood collectively can comprise a Yankee dryer. At the outlet side of the drying section, a creping doctor 56 is arranged to crepe the fibrous web off the drying cylinder 52. An application device 58 is provided for applying a suitable adhesive or other composition on the envelope surface of the drying cylinder 52. The resulting creped web is thereafter rolled into a parent roll (not shown) for subsequent conversion into the final product form as desired.

The press section 30 comprises at least one press, which has two cooperating first and second press members 31 and 32, which press members together define a press nip. Further, the press section comprises an endless press felt 33 that runs in a loop around the first press member 31 and guide rolls 34, and an endless impermeable transfer belt 35. The transfer belt 35 runs in a loop around the second press member 32 and a plurality of guide rolls 36. A suction roll (not numbered) is also shown in FIG. 1, within the loop of the felt 33 at a location where the felt 33 overlaps with the inner clothing 24, upstream of the press nip. This suction roll dewaters the felt 33 and the paper web prior to the press nip. For example, the suction roll can operate at a vacuum of about 40 kPa, whereby the paper web entering the press nip can have a dry solids content of about 15% to 20%.

In the embodiment shown in FIG. 1, the press is a shoe press in which the first press member comprises a shoe press roll 31 and the second press member comprises a counter roll 32. The shoe press roll and the counter roll define an extended press nip therebetween. Other types of presses can be used instead of a shoe press.

The papermaking machine further comprises a permeable final fabric 37 arranged to run in a loop around a suction transfer device 38 located adjacent to the transfer belt 35 to define a transfer point 40 for transfer of the paper web from the transfer belt 35 to the final fabric 37. The transfer point 40 is located at a distance D from the press nip, as measured along the path traversed by the transfer belt 35. The suction transfer device 38 forms a suction zone 41 operable to exert suction through the final fabric 37 to transfer the paper web from the transfer belt 35 onto the final fabric 37. In the case of manufacturing a structured tissue web, the final fabric comprises a structuring fabric (or "texturizing fabric") having a structured surface, and the suction exerted by the suction transfer device 38 further serves to mold the damp tissue web to the structured surface of the fabric. The "structuring fabric" can have about 25 or fewer machine direction-oriented knuckles or other raised surface features per square centimeter. The fabric 37 runs around a transfer roll 39, which defines a non-compressing nip with the drying cylinder 52 for transfer of the tissue web from the fabric 37 onto the drying cylinder 52.

In the embodiment shown in FIG. 1, the suction transfer device 38 is a suction roll having a suction zone 41 that encompasses a predetermined sector angle. The transfer belt 35 is arranged to partially wrap the curved outer surface of the suction device 38. As an alternative to a roll, the suction transfer device could be another type of suction device such as a suction shoe having a curved outer surface, or a suction box having a non-curved suction surface of a defined length L.

The characteristics of the transfer belt 35 and the arrangement of the transfer belt 35 in relation to the structuring fabric 37 and suction transfer device 38 are of particular importance in the case of the manufacture of low-basis-weight tissue webs, such as tissue webs having a basis weight of about 20 grams per square meter (gsm) or less, more specifically from about 10 to about 20 gsm, still more specifically from about 10 to about 15 gsm. As used herein, "basis weight" refers to the amount of bone dry fiber in the web while positioned on the drying cylinder 52 during the tissue making process. This is to be distinguished from "finished" basis weight, which can be influenced by the presence of crepe folds that foreshorten the web in the machine direction. However, the basis weight of a tissue web on the dryer can be closely estimated from a finished basis weight by measuring the basis weight of the tissue web after all of the machine-direction foreshortening has been pulled out. Tissue webs having such low basis weight are particularly difficult to handle in a papermaking machine because a wet tissue web has virtually no tensile strength. As a consequence, the process of separating the tissue web from the transfer belt 35 and transferring it onto the structuring fabric 37 is complicated by the extremely low strength of the web.

More particularly, as the transfer belt 35 with the tissue web thereon exits the press nip formed by the press members 31, 32, a thin water film exists between the tissue web and the surface of the transfer belt 35. It is theorized that as long as this water film is intact, the tissue web cannot be separated from the transfer belt without significant risk of the web breaking. It has been found through multiple trials of transfer belts having different properties that the surface characteristics of the transfer belt play an important role in determining whether or not the tissue web can be separated from the transfer belt. Specifically, it has been found that some types of transfer belts make it difficult or essentially impossible to separate the tissue web, while other types of transfer belts allow the tissue web to be separated (as long as other criteria are also met, as further described below). Based on these trials, it is theorized that the transfer belts that permit the web to be separated somehow allow the thin water film to dissipate or break up after a certain period of time has elapsed after the web exits the press nip, while the transfer belts that do not permit the web to be separated without breaking do not allow the water film to dissipate.

In view of the trial results, it has been found that a papermaking machine such as the one depicted in FIG. 1 can be used for making tissue webs of low basis weight (as previously noted), as long as the transfer belt 35 has the proper surface characteristics that allow the water film to dissipate, and as long as there is a sufficient time period (referred to herein as the "dwell time" $t_d$) for the water film to dissipate. The dwell time is the period of time it takes for the web to travel the distance D from the press nip to the transfer point 40. The dwell time (in seconds) is related to the speed V of the transfer belt 35 (in meters per minute) by the equation $t_d=(D/V)*60$. Thus, for example, if V=1000 m/min and D=4 m, then $t_d$ is equal to 0.24 second.

Regarding the surface characteristics of the transfer belt 35, it has been found that a transfer belt whose web-contacting surface is formed by a substantially nonporous polymeric coating, and which may have a surface that is ground or sanded to increase its surface roughness to an arithmetic average roughness of about Ra=2 to 5 μm generally does not allow the tissue web to be separated from the transfer belt even when the distance D is made long enough to provide a dwell time $t_d$ of at least 0.5 s. It should be noted that for reasons of machine compactness it is usually desired to keep the distance D as small as possible while still allowing the tissue web transfer to be carried out reliably without breaking the web. Thus, based on the trials that have been done, it was determined that transfer belts with a substantially nonporous polymeric coating cannot be used, even if sanded to increase their surface roughness.

Figure 7:
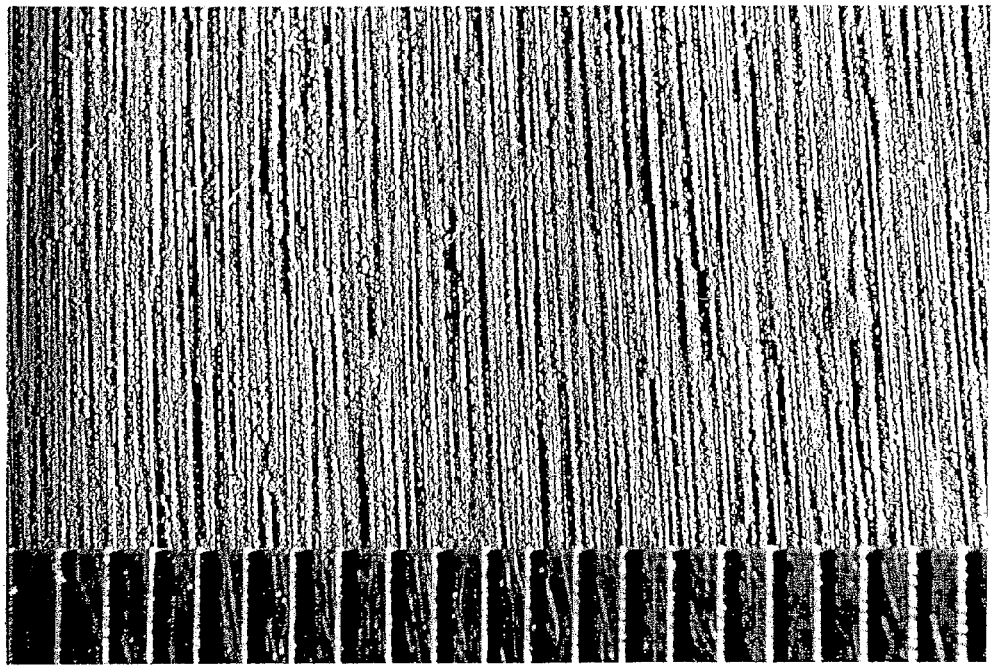
FIG. 7 is a magnified photograph of the surface of a type of transfer belt found to be unsuitable for the practice of the invention.
Figure 8:
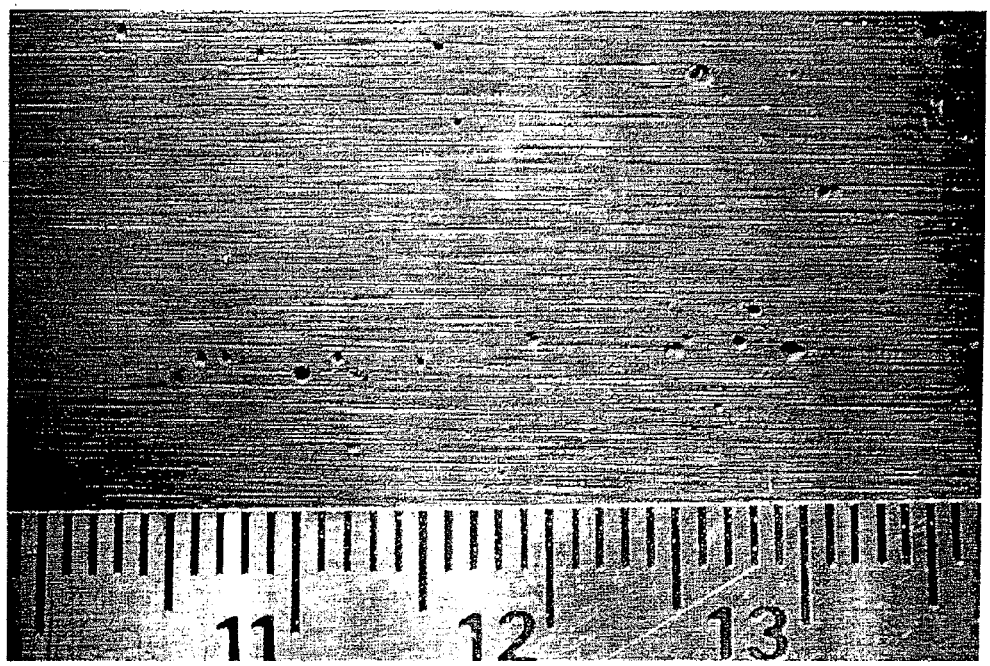
FIG. 8 is a magnified photograph of the surface of another type of transfer belt found to be unsuitable for the practice of the invention.

Such sanded or ground belts are generally ground using a drum sander and thus have a web-contacting surface that is characterized by a plurality of grooves or striations extending along the machine direction (MD), as can be seen in FIGS. 7 and 8 showing two types of such belts. FIG. 7 is a photograph of a T1 type TRANSBELT® available from Albany International Corp., and FIG. 8 is a photograph of a T2 type TRANSBELT® from Albany International Corp. The ruler shown in the photographs is a metric scale, the marks denoting millimeters. As further described below, such belts having ground-in MD striations have been found to be generally unsuitable for making tissue webs of low basis weight (i.e., less than 20 gsm) at high machine speeds (i.e., at least 1000 m/min.). The precise reason why such belts do not allow the web transfer to take place at high speed is not well-understood, but it is theorized that the striations do not allow the thin water film to break up, possibly because each striation is generally continuous and thus may allow the water contained therein to remain intact via surface-tension effects.

On the other hand, it has been found that a transfer belt having a web-contacting surface characterized by a non-uniform distribution of microscopic-scale depressions (also referred to as "pits" or "holes"), even though its surface roughness is in generally the same range as the ground belts discussed above (e.g., Ra of about 2 to about 10 μm), allows the tissue web to separate from the belt in a reasonably short distance D. As an example, a suitable transfer belt 35 can comprise a G3 TRANSBELT®, or an LA TRANSBELT®, which are available from Albany International Corp., and are substantially as described in U.S. Pat. No. 5,298,124, incorporated herein by reference. Alternatively, the transfer belt can be a T2-style transfer belt from Ichikawa Co., Ltd., substantially as described in U.S. Pat. No. 6,319,365 and U.S. Pat. No. 6,531,033, the disclosures of which are incorporated herein by reference. The surface of the belt is formed by a coating of a resin such as acrylic or aliphatic polyurethane, into which is blended a quantity of inorganic particulate filler such as kaolin clay. The embedded particles of the filler give the surface of the belt a surface topography characterized by a non-uniform or random distribution of depressions on the microscopic scale as that term has been previously defined. The particles have a particle size generally less than about 50 μm, and a substantial proportion of the particles are less than about 10 μm.

Figure 6:
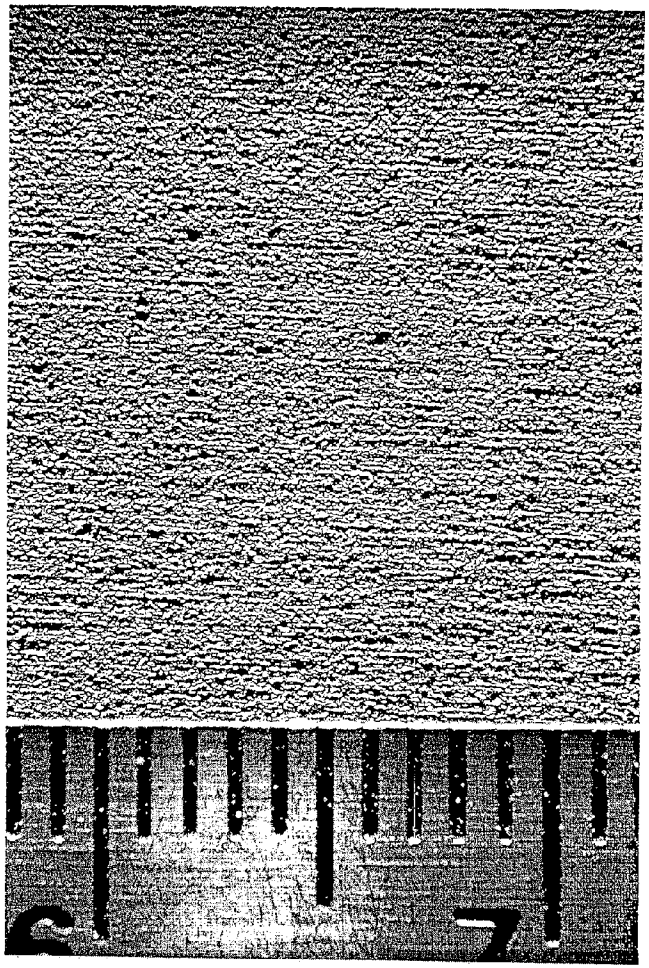
FIG. 6 is a magnified photograph of the surface of another type of transfer belt useful in the practice of the invention.
Figure 5:
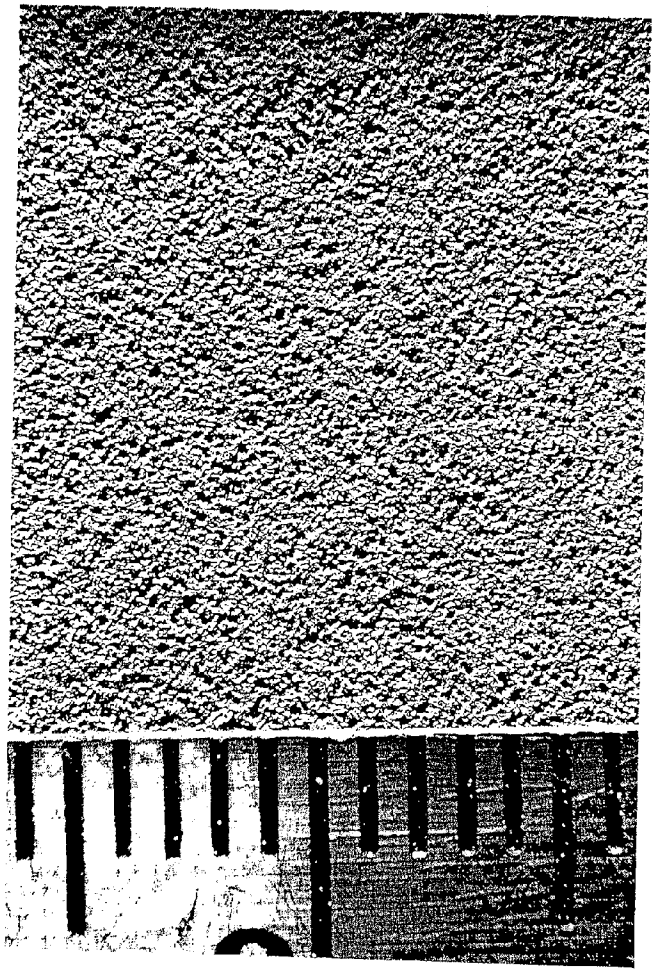
FIG. 5 is a magnified photograph of the surface of one type of transfer belt useful in the practice of the invention.

FIGS. 5 and 6 show magnified photographs of the surfaces of two such transfer belts suitable for use in the practice of the invention. FIG. 5 shows a G3 TRANSBELT® and FIG. 6 shows an LA TRANSBELT® both from Albany International Corp. It will be noted that the surfaces of these belts do not have unidirectional striations as in the belts of FIGS. 7 and 8, or at least any detectable striations are not the dominant surface characteristic. Instead, the dominant surface characteristic of the belts of FIGS. 5 and 6 is a non-uniform distribution of microscopic-scale depressions. The depressions have a range of diameters or sizes and a range of different shapes. The depression size is generally up to about 200 μm across. While the applicant does not wish to be bound by theory, it is thought that each depression can receive a tiny amount of water, and the water in one depression is separated from and thus not bound by surface-tension effects to the water in neighboring depressions, thereby allowing the thin water film effectively to break up and permit the paper web to be separated from the belt.

Even using the above-described type of "micro-depression" transfer belt, it is still necessary to meet a number of other criteria in order to assure that particularly low-basis-weight tissue webs can be successfully transferred to the structuring fabric 37 at the transfer point 40. These criteria include the dwell time $t_d$ as previously noted, the dryness of the web exiting the press nip, the amount of suction exerted by the suction transfer device 38, and the specific manner in which the transfer belt 35 engages the suction transfer device.

Regarding the dwell time $t_d$, for machine speeds (i.e., the linear speed of the transfer belt 35) of at least 1000 m/min up to a maximum of about 2000 m/min (more particularly, 1000 m/min to about 1700 m/min, and still more particularly about 1200 m/min to about 1700 m/min), the dwell time $t_d$ should be at least about 0.1 s, more particularly at least about 0.15 s, and still more particularly at least about 0.2 s. Based on the machine speed, the distance D can be estimated in order to provide the requisite dwell time. For example, if the machine speed has been set at 1500 m/min, then it can be estimated that the distance D likely should be at least about 2.5 m (to give a dwell time $t_d$ of at least 0.1 s), more likely should be at least about 3.75 m (to give a dwell time of about 0.15 s), and still more likely should be at least about 5 m (to give a dwell time of about 0.2 s). This initial estimate of the distance D may need to be adjusted somewhat based on other factors, but can provide at least a rough estimate of the minimum distance that is likely to be workable. Of course, the distance D can always be made longer than the estimated minimum.

With respect to the dryness of the tissue web leaving the press nip, in general, the dryer the web is, the easier it is to separate the web from the transfer belt 35 because the wet strength of the web generally increases with increasing dryness. Accordingly, as the web dryness increases, generally the distance D can be reduced; conversely, the less dry the web is, the greater the distance D must be, all other things being equal. The press section 30 of the papermaking machine 10 of FIG. 1 advantageously dewaters the tissue web to a dryness (i.e., dry solids content, on a weight percent basis) of at least 20%, more particularly at least about 35%, still more particularly from about 35% to about 53%, and even more particularly from about 40% to about 50%. Such dryness levels can be achieved with a peak pressure load in the press nip of from about 2 MPa to about 10 MPa, more particularly from about 4 MPa to about 6 MPa.

The level of vacuum in the suction transfer device 38 used to effect the transfer of the tissue web from the transfer belt 35 to the structuring fabric 37 will depend upon the nature of the structuring fabric. In general, the vacuum can be about 5 kPa or greater, more specifically from about 20 to about 70 kPa, still more specifically from about 30 to about 50 kPa. The vacuum at the vacuum transfer device plays a much more important role for transferring light-weight tissue webs from the transfer belt to the structuring fabric than it does for heavier paper grades. Because the wet web tensile strength is so low, the transfer must be 100 percent complete before the belt and fabric separate, or else the web will be damaged. On the other hand, for heavier-weight paper webs there is sufficient wet strength to accomplish the transfer, even over a short micro-draw, with modest vacuum (20 kPa). For light-weight tissue webs, the applied vacuum needs to be much stronger in order to cause the vapor beneath the tissue to expand rapidly and push the web away from the belt and transfer the web to the structuring fabric prior to fabric separation. On the other hand, the vacuum cannot be so strong as to cause pinholes in the sheet.

Figure 1A:
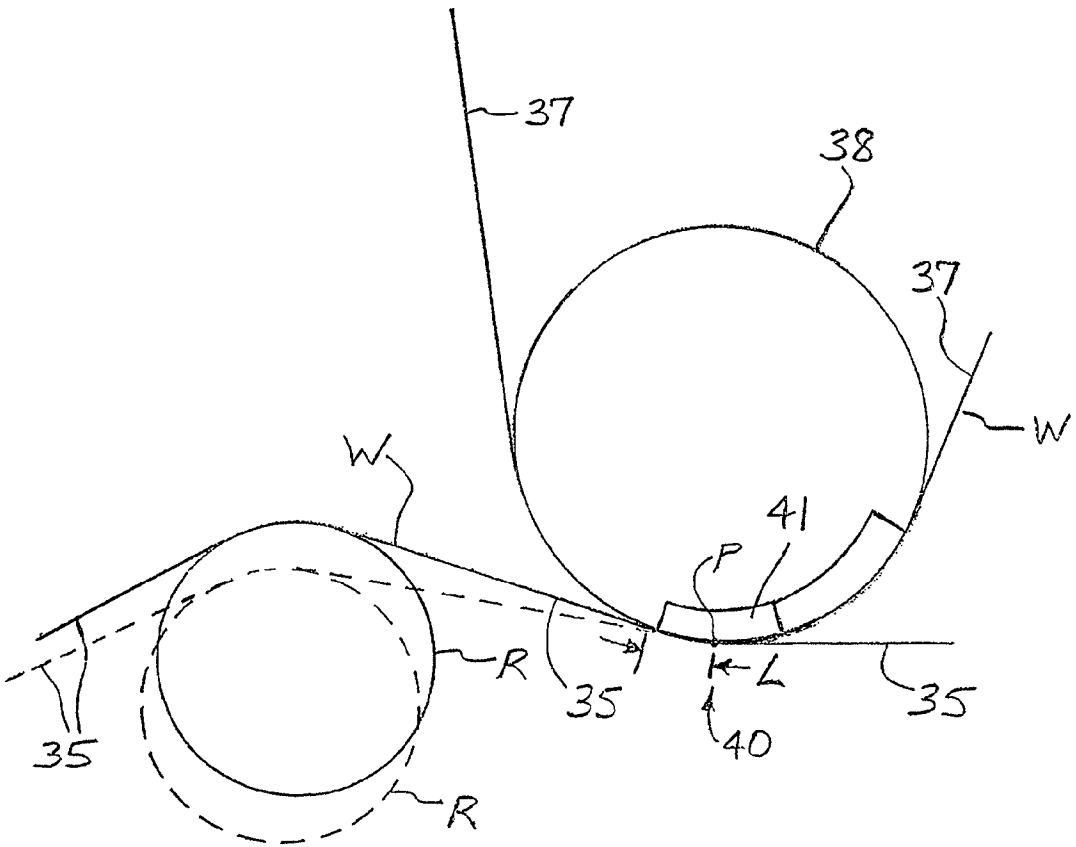
FIG. 1A shows a vacuum transfer device of the papermaking machine in accordance with one embodiment.

Additionally, as previously noted, the reliability of the web transfer onto the structuring fabric 37 is aided by properly configuring the suction transfer device 38 and its engagement with the transfer belt 35. In particular, the contact between the tissue web W on the transfer belt 35 and the structuring fabric 37 is not a tangential contact, but rather the contact area occupies a finite predetermined length L (FIG. 1A) in the machine direction along which the transfer belt 35 runs. This area of contact at least partially coincides with the suction zone 41 of the suction transfer device 38. More particularly, as shown in FIG. 1A, the area of contact having length L is delimited on the outgoing side by the point P at which the transfer belt 35 diverges or parts from the structuring fabric 37. The point P in particular embodiments can be located intermediate the upstream and downstream ends of the suction zone 41. In one embodiment as shown in FIG. 1A, the point P is located approximately midway between the upstream and downstream ends of the suction zone 41. Accordingly, there is a portion of the suction zone 41 that is not covered by the transfer belt 35 and thus is open. Air is drawn into this open portion of the suction zone, through the permeable structuring fabric 37 and tissue web, at relatively high speed. This helps to mold the tissue web W to the structuring surface of the fabric. If desired, as shown in FIG. 1, an additional suction device 42 can be disposed downstream of the suction transfer device 38 to further aid in molding the tissue web to the fabric. To further effect transfer and molding of the web to the structured surface of the fabric, the vacuum transfer roll may have a second holding zone following the suction zone 41, in which vacuum (generally at a lower level than in the suction zone 41) can be exerted. For instance, the second holding zone can have a vacuum of about 1 kPa to about 15 kPa.

In one embodiment, the point at which the transfer belt 35 first becomes tangent to the suction transfer device 38 defines an angle $\alpha$ measured between the transfer belt 35 and structuring fabric 37 and a horizontal plane, the upstream end of the suction zone defines an angle $\beta$ between the structuring fabric 37 and the horizontal plane, the point P at which the transfer belt 35 is tangent to the suction transfer device 38 at the outgoing side defines an angle $\gamma$ between the transfer belt 35 and the horizontal plane, and the downstream end of the suction zone defines an angle $\delta$ between the structuring fabric 37 and the horizontal plane. In one embodiment, the angle $\alpha$ can be about 31.7°, the angle $\beta$ can be about 30.7°, the angle $\gamma$ can be about 29.6°, and the angle $\delta$ can be about 11.9°. Thus, the total wrap of the transfer belt 35 about the suction transfer device is 2.1° ($\alpha$ minus $\gamma$), and the amount of that wrap subject to vacuum is 1.1° ($\beta$ minus $\gamma$). Given a suction transfer device diameter of about 800 mm, the wrap distance L corresponding to the 2.1° wrap is about 15 mm.

As also illustrated in FIG. 1A, the press section optionally can include an adjustable roll R for the transfer belt 35 disposed upstream of the suction transfer device 38, the adjustable guide roll being adjustable in position with respect to the suction transfer device for adjusting the length L between a first value and a second value. Thus, the roll R is shown in a first position in solid line, for causing the transfer belt 35 to wrap the suction transfer device with a greater wrap angle to produce a longer length L, and in a second position in broken line for causing the transfer belt to wrap the suction transfer device with a smaller wrap angle to reduce the length L. As an example, the greater wrap length can be used at start-up of the papermaking machine, and once the tissue web is running well, the roll R can be moved to reduce the wrap length.

As the tissue web is subjected to a high vacuum and the web is still damp during the suction phase, the structure of the tissue web W will remain after the suction device(s). To achieve the desired structuring it is also advantageous that the speed of the fabric 37 is not greater than, and preferably is less than, the speed of the transfer belt 35. In particular, this difference in speed can be from about 0% up to about 10%, more particularly about 0% to about 5%. However, in other embodiments, the speed of the fabric 37 can be slightly greater (e.g., up to about 3% greater) than that of the transfer belt 35 so as to effect a "draw" transfer of the tissue web W, although this is not preferred.

The length L of the contact area in particular embodiments can be at least about 10 mm and can be up to about 200 mm. More particularly, the length L can be from about 10 mm to about 50 mm. It will be understood that the distance L is measured during machine operation when the suction transfer device is applying suction and the transfer belt is suctioned against the device.

Figure 2:
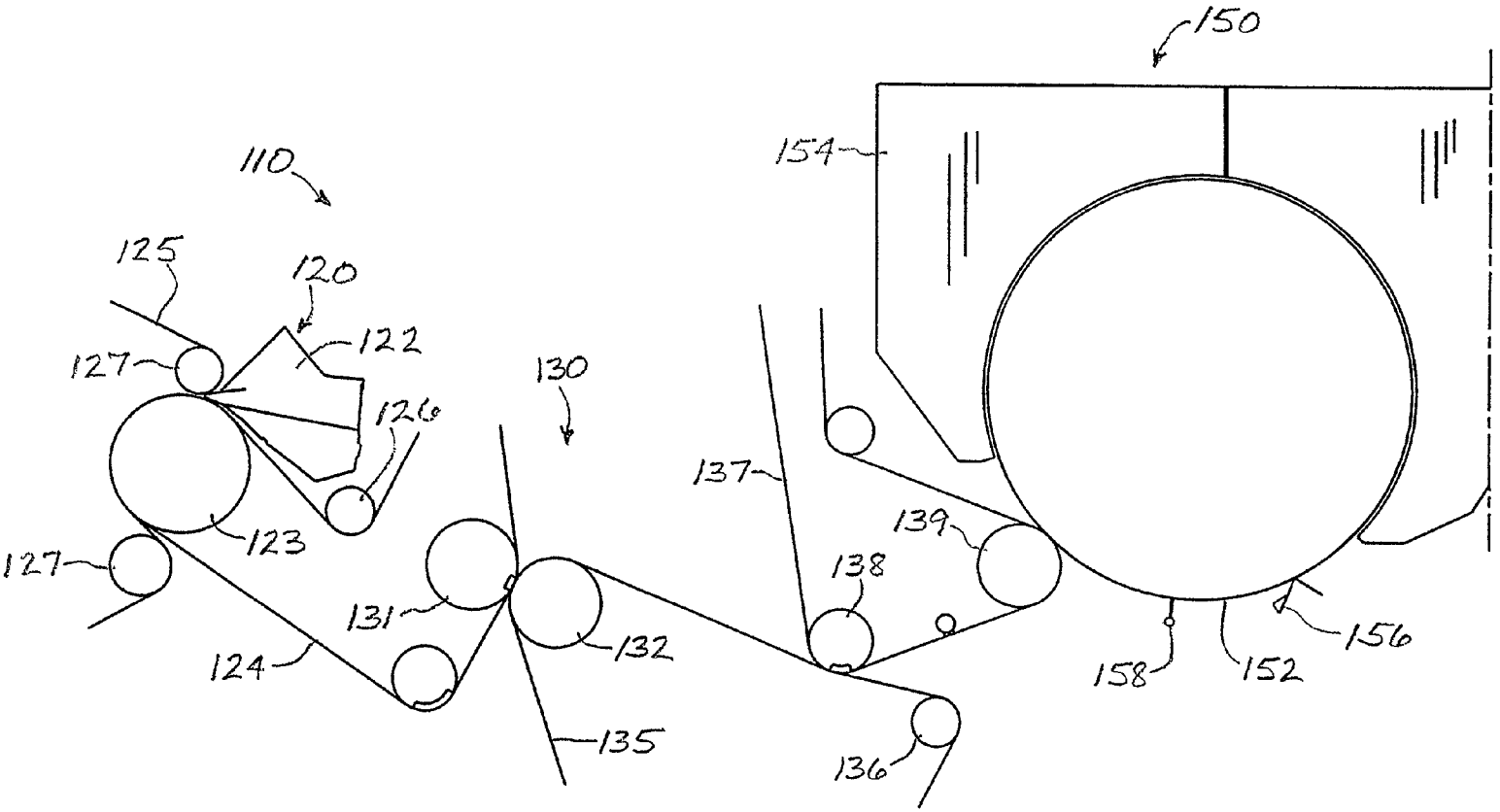
FIG. 2 is a schematic depiction of a papermaking machine in accordance with a second embodiment of the invention.

A papermaking machine 110 in accordance with another embodiment is shown in FIG. 2. This machine is generally similar to the machine 10 of FIG. 1. The machine includes a forming section 120, a press section 130 and a drying section 150. The forming section 120 comprises a headbox 122, a forming roll 123, an endless inner clothing 124, and an endless outer clothing 125 consisting of a forming wire. The inner and outer clothings 124 and 125 run in separate loops around several guide rolls 126 and 127 respectively.

The drying section 150 comprises a heated drying cylinder 152, which is covered by a hood 154. The drying cylinder and hood collectively can comprise a Yankee dryer. At the outlet side of the drying section, a creping doctor 156 is arranged to crepe the fibrous web off the drying cylinder 152. An application device 158 is provided for applying a suitable glue on the envelope surface of the drying cylinder 152.

The press section 130 comprises at least one press, which has two cooperating first and second press members 131 and 132, which press members together define a press nip. Preferably, the press is a shoe press in which the first press member comprises a shoe press roll 131 and the second press member comprises a counter roll 132. Further, the press section comprises an endless impermeable transfer belt 135. The transfer belt 135 runs in a loop around the second press member 132 and a plurality of guide rolls 136. Unlike the machine of FIG. 1, the machine 110 of FIG. 2 does not employ a separate press felt, but instead the wet tissue web is formed on the clothing 124, which passes through the press nip such that the tissue web is enclosed between the clothing 124 and the transfer belt 135. In other respects, the machine 110 is generally similar to the machine 10 described above, and the disclosure with respect to the machine 10 applies as well to the machine 110.

Figure 3:
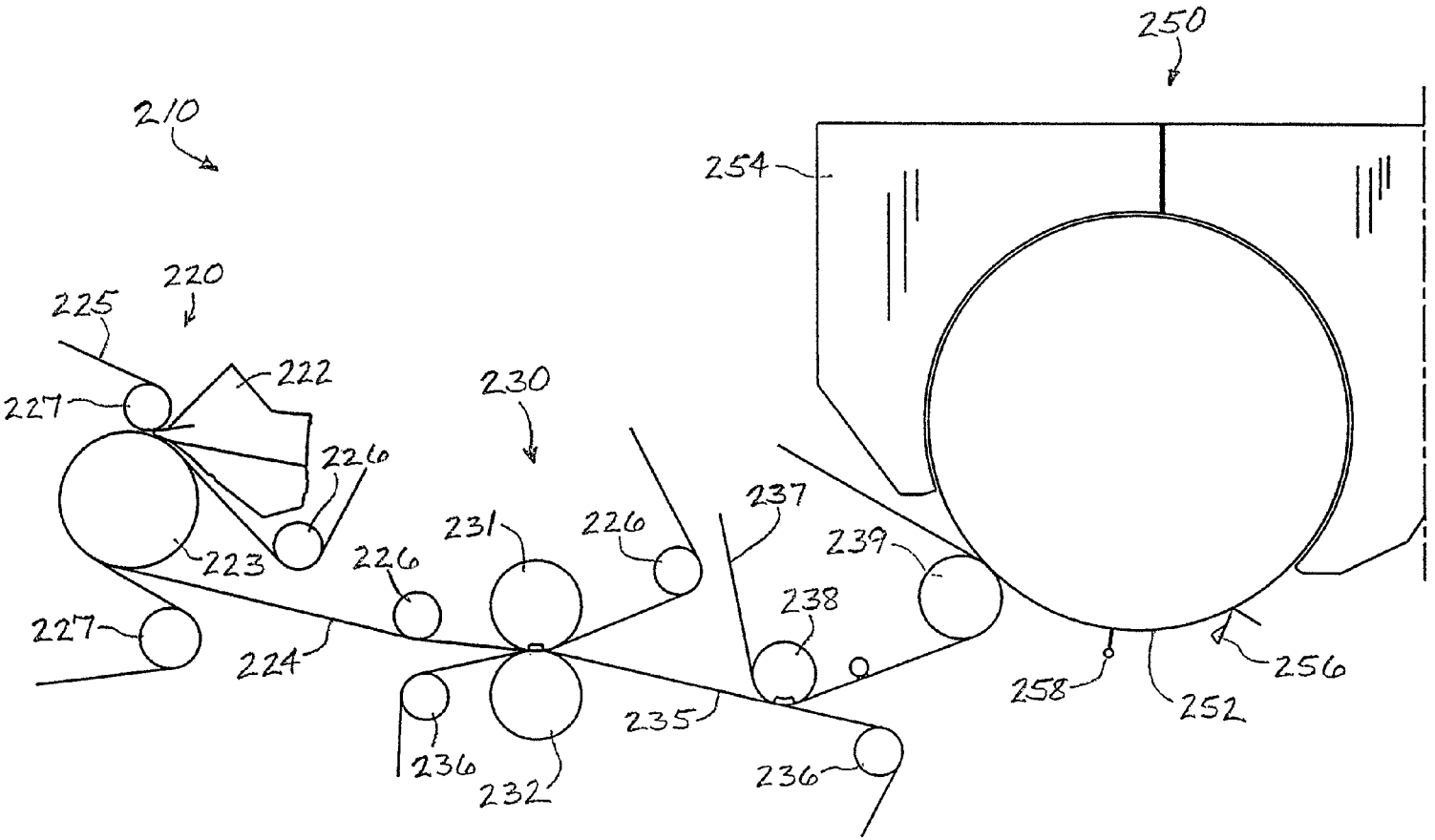
FIG. 3 is a schematic depiction of a papermaking machine in accordance with a third embodiment of the invention.

A papermaking machine 210 in accordance with a third embodiment is depicted in FIG. 3. The machine includes a forming section 220, a press section 230 and a drying section 250. The forming section 220 comprises a headbox 222, a forming roll 223, an endless inner clothing 224, and an endless outer clothing 225 consisting of a forming wire. The inner and outer clothings 224 and 225 run in separate loops around several guide rolls 226 and 227 respectively.

The drying section 250 comprises a heated drying cylinder 252, which is covered by a hood 254. The drying cylinder and hood collectively can comprise a Yankee dryer. At the outlet side of the drying section, a creping doctor 256 is arranged to crepe the fibrous web off the drying cylinder 252. An application device 258 is provided for applying a suitable coating on the envelope surface of the drying cylinder 252.

The press section 230 comprises at least one press, which has two cooperating first and second press members 231 and 232, which press members together define a press nip. Further, the press section comprises an endless impermeable transfer belt 235. The transfer belt 235 runs in a loop around the second press member 232 and a plurality of guide rolls 236. Unlike the machine of FIG. 1, the machine 210 of FIG. 3 does not employ a separate press felt, but instead the wet tissue web is formed on the clothing 224, which passes through the press nip such that the tissue web is enclosed between the clothing 224 and the transfer belt 235. In other respects, the machine 210 is generally similar to the machine 10 described above, and the disclosure with respect to the machine 10 applies as well to the machine 210.

Figure 4:
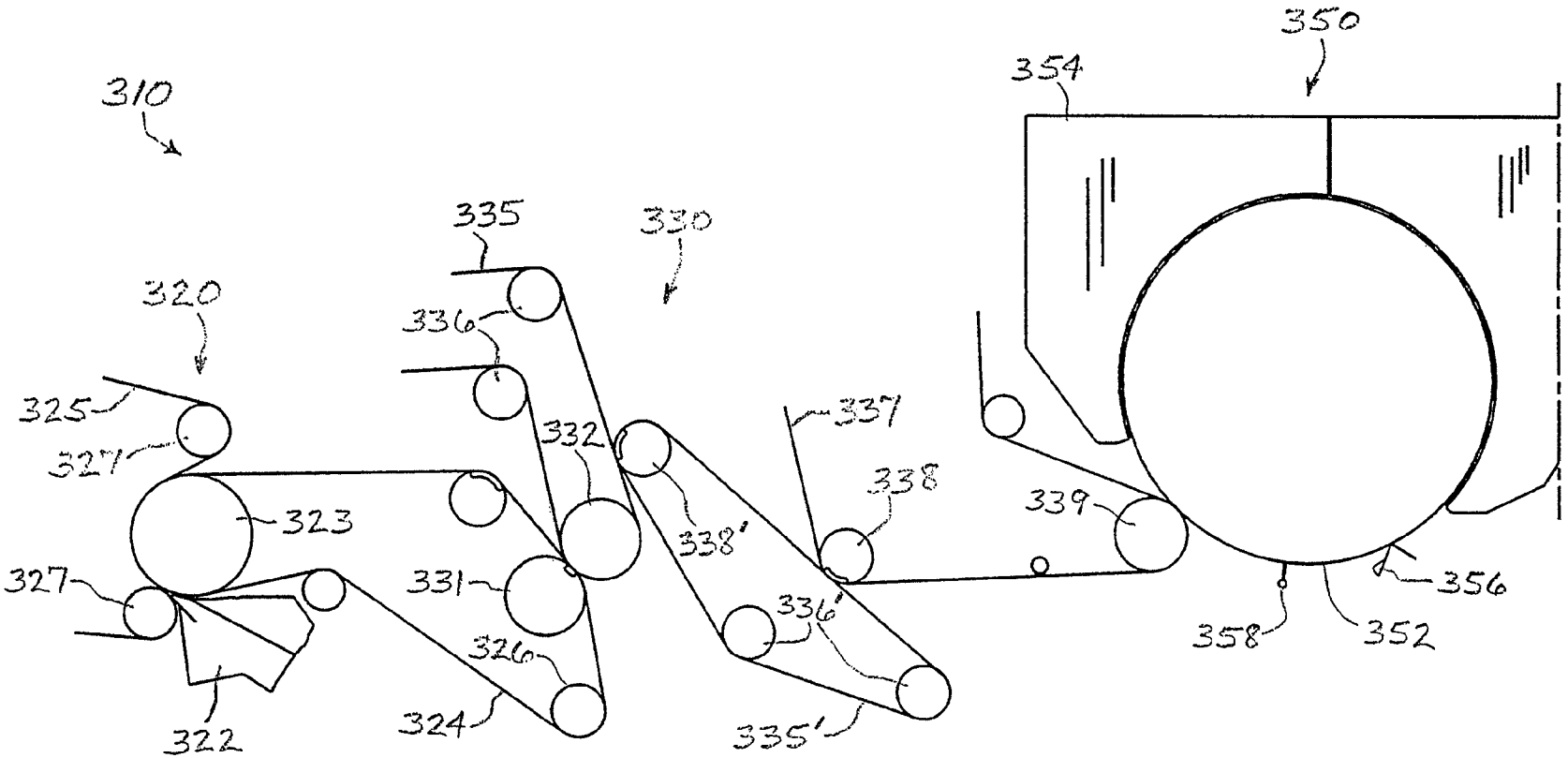
FIG. 4 is a schematic depiction of a papermaking machine in accordance with a fourth embodiment of the invention.

A papermaking machine 310 in accordance with a fourth embodiment is shown in FIG. 4. The machine includes a forming section 320, a press section 330 and a drying section 350. The forming section 320 comprises a headbox 322, a forming roll 323, an endless inner clothing 324, and an endless outer clothing 325 consisting of a forming wire. The inner and outer clothings 324 and 325 run in separate loops around several guide rolls 326 and 327 respectively.

The drying section 350 comprises a heated drying cylinder 352, which is covered by a hood 354. The drying cylinder and hood collectively can comprise a Yankee dryer. At the outlet side of the drying section, a creping doctor 356 is arranged to crepe the fibrous web off the drying cylinder 352. An application device 358 is provided for applying a suitable coating on the envelope surface of the drying cylinder 352.

The press section 330 comprises at least one press, which has two cooperating first and second press members 331 and 332, which press members together define a press nip. Further, the press section comprises an endless impermeable transfer belt 335. The transfer belt 335 runs in a loop around the second press member 332 and a plurality of guide rolls 336. As in the machines of FIGS. 2 and 3, the machine 310 of FIG. 4 forms the wet tissue web on the clothing 324, which passes through the press nip such that the tissue web is enclosed between the clothing 324 and the transfer belt 335.

Unlike the machines of FIGS. 2 and 3, however, the machine 310 includes a further permeable belt 335' that runs in an endless loop about guide rolls 336' and about a suction transfer device 338'. The tissue web on the transfer belt 335 is brought into engagement with the permeable belt 335' on the suction transfer device 338' such that the tissue web is transferred onto the permeable belt. The tissue web is then transferred onto the structuring fabric 337 with the aid of the suction transfer device 338 about which the structuring fabric is partially wrapped. The tissue web is molded to the surface of the fabric 337 and is then transferred by the transfer roll 339 onto the drying cylinder 352 of the drying section 350. The drying section includes a hood 354, a creping doctor 356, and an application device 358 as in previously described embodiments.

The bulk of the tissue sheets produced by the papermaking machine in accordance with the present disclosure can be about 10 cubic centimeters or greater per gram (cc/g) of fiber, more specifically from about 10 to about 20 cc/g.

As used herein, "bulk" is calculated as the quotient of the "caliper" (hereinafter defined) of a tissue sheet, expressed in microns, divided by the dry basis weight, expressed in grams per square meter. The resulting sheet bulk is expressed in cubic centimeters per gram. More specifically, the tissue sheet caliper is the representative thickness of a single tissue sheet measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" with Note 3 for stacked sheets. The micrometer used for carrying out T411 om-89 is an Emveco 200-A Tissue Caliper Tester available from Emveco, Inc., Newberg, Oreg. The micrometer has a load of 2 kilo-Pascals, a pressure foot area of 2500 square millimeters, a pressure foot diameter of 56.42 millimeters, a dwell time of 3 seconds and a lowering rate of 0.8 millimeters per second.

As used herein, the "machine direction (MD) tensile strength" is the peak load per 3 inches of sample width when a sample is pulled to rupture in the machine direction. Similarly, the "cross-machine direction (CD) tensile strength" is the peak load per 3 inches of sample width when a sample is pulled to rupture in the cross-machine direction. The percent elongation of the sample prior to breaking is the "stretch".

The procedure for measuring tensile strength and stretch is as follows. Samples for tensile strength testing are prepared by cutting a 3 inches (76.2 mm) wide by 5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Serial No. 37333). The instrument used for measuring tensile strengths is an MTS Systems Sintech 11S, Serial No. 6233. The data acquisition software is MTS TestWorks® for Windows Ver. 3.10 (MTS Systems Corp., Research Triangle Park, N.C.). The load cell is selected from either a 50 Newton or 100 Newton maximum, depending on the strength of the sample being tested, such that the majority of peak load values fall between 10% and 90% of the load cell's full scale value. The gauge length between jaws is 4+/−0.04 inches (101.6+/−1 mm). The jaws are operated using pneumatic-action and are rubber coated. The minimum grip face width is 3 inches (76.2 mm), and the approximate height of a jaw is 0.5 inches (12.7 mm). The crosshead speed is 10+/−0.4 inches/min (254+/−1 mm/min), and the break sensitivity is set at 65%. The sample is placed in the jaws of the instrument, centered both vertically and horizontally. The test is then started and ends when the specimen breaks. The peak load is recorded as either the "MD tensile strength" or the "CD tensile strength" of the specimen depending on direction of the sample being tested. At least six (6) representative specimens are tested for each product or sheet, taken "as is", and the arithmetic average of all individual specimen tests is either the MD or CD tensile strength for the product or sheet.

"Surface roughness" of the transfer belts can be measured by several methods, including optical microscopy of cross-sections of the belt, or by stylus profilometry of the surface. Since the roughness of the belt surface may differ in the MD and CD directions with the CD value typically greater, the stated roughness is the CD roughness. A suitable portable device that enables in-field measurement is made by Taylor-Hobson Corporation, Model Surtronic 25 Ra.

EXAMPLES

Example 1

Comparative

A twin-wire former was used to make a lightweight paper sheet of less than 20 gsm. The papermaking machine speed was 600 m/min. The wet paper web was transferred to a felt and partially dewatered with vacuum to a dryness of about 25% dry solids content. The web was then compressively dewatered with an extended nip press at a load of 400 kN/m, with a peak pressure of 4 MPa, to a dryness of about 40%. The felt and tissue web were pressed against a belt similar to an Albany T2 transfer belt with a roughness Ra of about 6 micrometers as measure by stylus profilometry. Upon exiting the press the sheet was attached to the transfer belt. The transfer belt and paper traveled around the press roll and were then contacted with a texturizing fabric (style 44GST) manufactured by Albany. The distance from the press to the vacuum roll was about 2.4 meters. The texturizing fabric was in contact with the tissue web for a distance of about 25 mm after it came into contact with the vacuum roll. Just prior to separation of the fabric and the transfer belt, a high vacuum level exceeding 20 kPa was supplied from inside the vacuum roll, causing the tissue web to transfer from the transfer belt to the fabric. The tissue web and fabric traveled together to a pressure roll at the Yankee dryer, where the tissue web was pressed to the Yankee. The tissue web adhered to the Yankee with the aid of adhesives sprayed onto the Yankee surface prior to the pressure roll. The sheet was dried and creped and wound up at a speed 20% slower than the Yankee speed. The resulting physical properties were measured:

| | | |
|---|---|---|
| Basis weight (bone dry) | $g/m^2$ | 16.0 |
| Caliper | μm | 220 |
| Bulk | $cm^3/g$ | 13.8 |
| Stretch MD | % | 28.5 |
| Stretch CD | % | 7.7 |
| Tensile MD | N/m | 80 |
| Tensile CD | N/m | 35 |

Example 2

Comparative

The conditions of Example 1 were repeated with a higher machine speed of 1000 m/min. The transfer of the tissue web to the fabric failed. From these trials, it was determined that the Albany T2 type of belt is not suitable for high-speed manufacture of low basis-weight paper in the type of process described herein.

Example 3

The conditions of Example 1 were repeated with a transfer belt similar to an Albany LA particle belt with a roughness of 3 micrometers. The tissue web transferred to the fabric at speeds up to 1200 m/min. Product samples were taken at 600 meters/minute because of limitations with the reel, but the properties of sheets produced at higher speeds are believed to be very similar. The properties of the tissue were as follows:

| | | |
|---|---|---|
| Basis weight (bone dry) | $g/m^2$ | 16.9 |
| Caliper | μm | 283 |
| Bulk | $cm^3/g$ | 16.7 |
| Stretch MD | % | 39.8 |
| Stretch CD | % | 12.4 |
| Tensile MD | N/m | 81 |
| Tensile CD | N/m | 41 |

This Example illustrates that the use of a particle belt as the transfer belt enables transfer of the web at higher speeds than conventional transfer belts.

Example 4

The process of Example 3 was repeated, except the distance from the press to the vacuum roll was increased from 2.4 meters to 4 meters. The tissue web transferred to the fabric at speeds up to 1400 m/min. The consistency of the paper transferred to the dryer was 48% dry solids content, resulting in 22% less water evaporation compared to a normal wet-press process, and 50-60% less water evaporation than a typical through-air-drying process. This Example illustrates that the maximum speed at which the paper web will transfer is increased with increased residence time on the transfer belt prior to transfer to the texturizing fabric.

Example 5

Example 4 conditions were repeated with an Albany G3 style belt. The tissue web transferred to the fabric at speeds up to 1600 meters/minute. From these trials, it was determined that the Albany LA and G3 type belts are suitable for high-speed manufacture of low basis-weight paper in the type of process described herein. This Example illustrates that altering the surface structure of the particle belt can improve transfer to the texturizing fabric.

Example 6

Example 5 conditions were repeated, but the contact between the texturizing fabric and the transfer belt was increased to over 100 mm and the vacuum zone of the vacuum roll was adjusted to cover at least half of that region. The tissue web was transferred to the texturizing fabric with ease at vacuum levels of 5 kPa. This Example illustrates that the residence time under vacuum at the transfer roll can improve transfer to the texturizing fabric.

Example 7

A crescent former was used to make a lightweight paper sheet of 13.8 gsm using the process illustrated in FIG. 1. The furnish was a blend of northern softwood and eucalyptus fibers. The paper machine speed at the Yankee dryer was 800 meters/minute. The wet tissue web was transferred to a felt and partially dewatered with vacuum to a consistency of about 25% solids. The web was then compressively dewatered with an extended nip press at a load of 600 kN/m, with a peak pressure of 6 MPa. The felt and web were pressed against a smooth belt similar to an Albany LA particle transfer belt with a roughness of about 3 micrometers. Upon exiting the press, the web was adhered to the transfer belt. The belt and web traveled around the press roll and were then brought into contact with a texturizing fabric that had been sanded to improve subsequent contact area with the surface of the Yankee dryer. The estimated contact area was about 30% under a 1.7 MPa load. The distance from the press to the vacuum roll was about 4 meters. The texturizing fabric was in contact with the transfer belt and tissue web for a distance of about 25 mm after it came into contact with a vacuum roll. Just prior to separation of the fabric and the transfer belt, a high vacuum level about 30 kPa was supplied from inside a vacuum roll, causing the web to transfer from the transfer belt to the texturizing fabric. There was a 5% rush transfer at the time of the transfer of the web to the fabric, but this speed differential is optional. The web and fabric traveled together to a pressure roll at the Yankee dryer, where the molded web was pressed to the surface of the Yankee dryer. The web adhered to the Yankee with the aid of adhesives sprayed onto the Yankee surface prior to the pressure roll. The web was dried and creped to a moisture content of 1-2% and wound up at a speed 20% slower than the Yankee speed. The physical properties of the resulting tissue sheet were as follows:

| | | |
|---|---|---|
| Basis weight (bone dry) | gsm | 17.3 |
| Caliper | μm | 300 |
| Bulk | cc/g | 17.3 |
| Stretch (MD) | % | 39.6 |
| Stretch (CD) | % | 9.6 |
| Tensile strength (MD) | N/m | 125 |
| Tensile strength (CD) | N/m | 54 |

The tissue sheet was converted into 2-ply bath tissue with calendering and exhibited good softness.

Example 8

A tissue sheet was made generally as described in Example 7, except that the paper machine speed at the Yankee dryer was 1000 m/min and the texturizing fabric was of a different style. The dryer basis weight was 13.7 gsm. There was a 3% rush transfer of the web to the fabric. The physical properties of the resulting tissue sheet were as follows:

| | | |
|---|---|---|
| Basis weight (bone dry) | gsm | 17.1 |
| Caliper | μm | 293 |
| Bulk | cc/g | 14.2 |
| Stretch (MD) | % | 28.8 |
| Stretch (CD) | % | 6.9 |
| Tensile strength (MD) | N/m | 124 |
| Tensile strength (CD) | N/m | 41 |

Example 9

A tissue sheet was made generally as described in Example 7 but with slightly less tensile strength in order to develop more softness in the final product. The physical properties of the resulting tissue sheet were as follows:

| | | |
|---|---|---|
| Basis weight (bone dry) | gsm | 18.1 |
| Caliper | μm | 311 |
| Bulk | cc/g | 17.2 |
| Stretch (MD) | % | 35.3 |
| Stretch (CD) | % | 11.2 |
| Tensile strength (MD) | N/m | 75 |
| Tensile strength (CD) | N/m | 39 |

The basesheet was then converted into a 2-ply roll of bath tissue by plying the basesheet with another roll of similar properties, with the fabric-facing side of the basesheets facing each other in the final product. The 2-ply product was calendered with steel rollers spaced apart by 635 micron (0.025 inch) and 35.5 meters of tissue were wound onto a 43 mm diameter core. This product was preferred over existing commercial bath tissue product in consumer testing. The resulting physical properties of the finished product were as follows:

| | | |
|---|---|---|
| Basis weight (bone dry) | gsm | 31.2 |
| Caliper | μm | 344 |
| Bulk | cc/g | 11.0 |
| Stretch (MD) | % | 16.6 |
| Stretch (CD) | % | 6.8 |
| Tensile (MD) | N/m | 156 |
| Tensile (CD) | N/m | 65 |
| Roll diameter | mm | 123 |
| Roll Bulk | cc/g | 10.2 |

The foregoing examples illustrate the ability of the process to make a wide range of products of high bulk at high rate of production on the paper machine and at a reduced energy usage for drying the paper.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for carrying a tissue web having a basis weight between 10 and 20 g/m$^2$ from a press nip to a dryer section in a papermaking machine, the method comprising the steps of:

leading a press fabric to pass through the press nip;

leading an impermeable transfer belt to pass through the press nip with a wet tissue web enclosed between the press fabric and the transfer belt, the tissue web adhering to and following the transfer belt after the press fabric and transfer belt diverge downstream of the press nip, the transfer belt having a surface in contact with the tissue web characterized by a non-uniform distribution of microscopic-scale depressions, the transfer belt traveling in a machine direction at a speed of about 1000 m/min. or greater;

carrying the tissue web on the transfer belt to a suction transfer device having a permeable structuring fabric partially wrapped thereabout, the suction transfer device defining a suction zone, the transfer belt being arranged to partially wrap about the suction transfer device, the transfer belt bringing the tissue web into contact with the structuring fabric in the suction zone for a length L in the machine direction, such that suction is exerted on the tissue web to transfer the tissue web from the transfer belt onto the structuring fabric at a transfer point; and arranging the transfer belt and suction transfer device such that the transfer belt and tissue web travel a distance D from the press nip to the transfer point, the distance D being selected taking into account at least the speed of the transfer belt, the basis weight of the tissue web, and a roughness characteristic of the surface of the transfer belt in contact with the tissue web, such that within the distance D a thin water film between the tissue web and the surface of the transfer belt at least partially dissipates to allow the tissue web to be separated from the transfer belt and to be suctioned onto the structuring fabric.

2. The method of claim 1, further comprising the steps of providing the structuring fabric with a structured surface, and using the suction transfer device to suction the tissue web onto the structured surface and conform thereto so as to structure the tissue web.

3. A method for using an impermeable transfer belt in a papermaking machine, the transfer belt having a web-contacting surface characterized by a non-uniform distribution of microscopic-scale depressions, the papermaking machine having two cooperating press members forming a press nip therebetween and a press felt arranged in a loop such that the press felt and a wet paper web pass through the press nip, having a permeable final fabric in form of a structuring fabric arranged in a loop within which a suction transfer device defining a suction zone is disposed, and having a drying cylinder onto which the structuring fabric transfers the paper web to dry the paper web, the method comprising the steps of:

arranging the impermeable transfer belt to pass through the press nip with the wet paper web enclosed between the press fabric and the transfer belt with the paper web against the web-contacting surface of the transfer belt, the transfer belt traveling in a machine direction at a speed of about 1000 m/min or greater, the paper web adhering to and following the transfer belt after the press fabric and transfer belt diverge downstream of the press nip;

carrying the tissue web on the transfer belt to the suction transfer device having the permeable structuring fabric partially wrapped thereabout, and causing the transfer belt to bring the paper web into contact with the structuring fabric in the suction zone for a length L in the machine direction, such that suction is exerted on the paper web to transfer the paper web from the transfer belt onto the structuring fabric at a transfer point; and arranging the transfer belt and suction transfer device such that the transfer belt and paper web travel a distance D from the press nip to the transfer point, the distance D being selected taking into account at least the speed of the transfer belt, the basis weight of the paper web, and a roughness characteristic of the web-contacting surface of the transfer belt, such that within the distance D a thin water film between the paper web and the surface of the transfer belt at least partially dissipates to allow the paper web to be separated from the transfer belt and to be structured onto the structuring fabric.

* * * * *